US007089618B1

(12) United States Patent
Metzger

(10) Patent No.: US 7,089,618 B1
(45) Date of Patent: Aug. 15, 2006

(54) AIR MATTRESS

(75) Inventor: Andrew T. Metzger, Belle Plain, KS (US)

(73) Assignee: The Coleman Company, Inc., Wichita, KS (US)

( * ) Notice: Subject to any disclaimer, the term of this patent is extended or adjusted under 35 U.S.C. 154(b) by 0 days.

(21) Appl. No.: 10/465,708

(22) Filed: Jun. 18, 2003

(51) Int. Cl.
*A47C 27/08* (2006.01)
*A47C 27/045* (2006.01)

(52) U.S. Cl. ..... 5/709; 5/712; 5/739

(58) Field of Classification Search ..... 5/706, 5/711, 713, 710, 712, 739, 709
See application file for complete search history.

(56) References Cited

U.S. PATENT DOCUMENTS

| | | | | | |
|---|---|---|---|---|---|
| 1,610,898 | A | * | 12/1926 | Steiner | 5/712 |
| 2,360,715 | A | * | 10/1944 | Perry | 5/654 |
| 3,604,027 | A | * | 9/1971 | Konno | 5/716 |
| 3,608,107 | A | * | 9/1971 | Kentor et al. | 5/716 |
| 3,780,388 | A | | 12/1973 | Thomas et al. | 5/349 |
| 4,181,990 | A | | 1/1980 | Santo | 5/452 |
| 4,371,999 | A | | 2/1983 | Reid | 5/457 |
| 4,541,135 | A | | 9/1985 | Karpov | 5/455 |
| 4,547,919 | A | | 10/1985 | Wang | 5/455 |
| 4,644,597 | A | * | 2/1987 | Walker | 5/711 |
| 4,782,542 | A | * | 11/1988 | Sato | 5/706 |
| 4,823,417 | A | | 4/1989 | Fukuichi | 5/455 |
| 5,452,487 | A | * | 9/1995 | Leggett | 5/709 |
| 5,598,593 | A | | 2/1997 | Wolfe | 5/710 |
| 5,608,931 | A | | 3/1997 | Gancy | 5/712 |
| 5,729,840 | A | | 3/1998 | Wu | 4/588 |
| 5,746,873 | A | | 5/1998 | Graf | 156/274.4 |
| 5,852,839 | A | | 12/1998 | Gancy | 5/706 |
| 5,960,495 | A | | 10/1999 | Hsu et al. | 5/706 |
| 6,073,291 | A | * | 6/2000 | Davis | 5/711 |
| 6,161,231 | A | | 12/2000 | Kraft et al. | 5/18.1 |
| 6,568,011 | B1 | | 5/2003 | Fisher et al. | 5/706 |
| 6,701,559 | B1 | * | 3/2004 | Boso et al. | 5/739 |
| 2003/0188388 | A1 | * | 10/2003 | Boso et al. | 5/710 |

FOREIGN PATENT DOCUMENTS

| | | |
|---|---|---|
| WO | WO 90/07891 | 7/1990 |

* cited by examiner

*Primary Examiner*—Michael Safavi
(74) *Attorney, Agent, or Firm*—Leydig, Voit & Mayer, Ltd.

(57) ABSTRACT

An air mattress or bed is disclosed. The air mattress has a first panel, a spaced second panel, and at least one side panel extending between the first panel and the second panel, each panel being joined to the other along their common peripheral edges to define a single air chamber therebetween. At least one mattress coil is disposed within the air chamber and is affixed to and extends therein from the first panel to the second panel. The air mattress further comprises at least one side support beam extending in the lengthwise direction of the at least one side panel. The side support beam has a first edge affixed to the at least one side panel and a spaced second edge affixed to at least one of the first panel and the second panel.

21 Claims, 3 Drawing Sheets

AIR MATTRESS

FIELD OF THE INVENTION

The invention relates in general to air mattresses or beds. More particularly, the present invention relates to an air mattress or bed constructed to limit the expansion or deformation of the mattress during use.

BACKGROUND OF THE INVENTION

The use of air mattresses or beds is well known. A great many types of air mattresses are known to exist, and are used widely for recreational purposes, for example as swimming pool floats, as well as for home use as a portable mattress or guest bed.

As first developed and used, air mattresses were typically formed of a single layer or height reinforced internally by a spaced series of elongate beams, referred to by those skilled in the art as I-beams. These I-beams are typically extended in the lengthwise direction of the mattress and were secured to the top and bottom faces or panels of the mattress so that the mattress would hold its shape somewhat as a load, typically a person, was placed thereon. Although well adapted for their intended use as pool floats or as pool-side mattresses for sunning and the like, these first generation air mattresses did not perform as well in the role of bedding, a such.

Accordingly, an entire industry of manufacturing air beds or mattresses developed to meet and exploit this need. As first developed, air mattresses or beds were formed to be somewhat sturdier in construction than the pool float type of air mattress through the use of heavier gauge plastics, typically polyvinylchloride (PVC) and the like, with improved interior constructions. Examples of such a single layer or height air mattress are shown in U.S. Pat. No. 3,780,388 to Thomas et al., for an inflatable air mattress of single width, i.e., a twin mattress, as well as U.S. Pat. No. 4,371,999 to Reid. An example of a double width, i.e., a full size, single layer air mattress is shown in U.S. Pat. No. 5,960,495 to Hsu et al. Common among both of these mattress designs is the use of internal "beams" or web strips for directly tying the top face and the bottom face of the air mattress together.

As the use of air mattresses for bedding continued, the need was perceived for mattresses of greater comfort levels, which resulted in air mattresses of greater height or thickness such that air mattresses more closely resembled a box spring and mattress combination in function, and ultimately height, this type of an air mattress being known as a two layer or a double height air mattress. Examples of this type of mattress are shown in U.S. Pat. No. 4,547,919 to Wang; U.S. Pat. No. 5,598,593 to Wolfe, and U.S. Pat. No. 6,568,011 to Fisher et al., respectively. As shown in the '011 patent to Fisher et al., the double height air mattress or air bed is essentially comprised of two stacked single height air mattresses formed with a lower chamber and a separate upper chamber. This is also shown in U.S. Pat. No. 6,073,291 to Davis.

Although this type of double height air mattress construction has provided increased comfort levels over single layer or height air mattresses, problems with these known types of mattress construction remain, chief among them being the inability to internally support the mattress so that any internal beams or columns used to form the mattress extend continuously from the bottom face to the top face of the mattress for more uniformly strengthening the mattress, and for more uniformly limiting the expansion or deflection of the mattress faces during use. This is not possible with the known constructions as an intermediate sheet or layer of plastic material typically divides the two chambers or layers from one another.

Another problem that arises with the use of the known air mattresses, and especially with the double height or two layer air mattresses, is the expansion of the mattress sidewall extended between the top face and the bottom face of the mattress. As known, when a person lays on the mattress a load is introduced which increases the pressure of the air trapped within the mattress, which pressurized air acts on and seeks to expand or deflect the sidewall of the mattress. This expansion needs to be limited so that the mattress holds its shape and will support the user in a comfortable sleeping position more akin to that of a conventional coil and spring mattress.

Efforts have been made to limit the sidewall expansion of air mattresses, examples of which are reflected in U.S. Pat. Nos. 5,068,931 and 5,852,839 to Gancy, disclosing spring-like couplings extended between the top face and the bottom face, and along the sidewalls, of a conventional single height air mattress. The devices of the two Gancy patents are somewhat complicated requiring a number of discrete weld or fastening points between the faces and walls of the mattress, thus increasing the likelihood of leaks developing at these fastening points in the mattress over time. Moreover, the devices of the '931 and '839 patents do not seem well suited for use with a double height mattress where the possibility of sidewall deflection is increased due to both to the size of the mattress and the loads that will be received thereon.

Another effort to resolve the problem of bulging air mattress side walls is presented in U.S. Pat. No. 4,541,135 to Karpov, which teaches a single layer or height air mattress having an inflatable tube, a second compartment ringing the air mattress, which is itself divided into two sub-chambers. The inflatable tube of Karpov is provided to support to the side walls of the mattress, but is itself an additional air chamber, and in reality two additional air chambers, susceptible to leakage.

What is needed, therefore, but appears to be unknown or otherwise available through the art, is a double height air mattress that may use a single internal air chamber and that will permit an internal support member, or members, to continuously extend between the top and bottom faces of the mattress. Moreover, such a need exists for an improved double height air mattress better adapted for controlling or limiting the expansion or deflection of the mattress sidewall, or sidewalls, during usage.

SUMMARY OF THE INVENTION

The present invention provides an improved air mattress construction which overcomes some of the design deficiencies of the known art.

In a first embodiment, the invention discloses an air mattress comprised of a first or top panel and a spaced second or bottom panel, and at least one side panel extending between the first panel and the second panel, the respective panels being joined together along their common peripheral edges to define a single air chamber therebetween. At least one mattress coil is disposed within the air chamber, and is affixed directly to and extends continuously within the air chamber from and between the first panel and the second panel thereof.

The air mattress may further comprise at least one side support beam extending in the lengthwise direction of the at least one side panel, the side support beam having a first edge affixed to the at least one side panel, and a second edge affixed to at least one of the first panel and the second panel. The second edge of the side support beam may be affixed to either the first or the second panel of the mattress, as desired. The side support beam, or beams, are therefore constructed and arranged to limit the outward expansion of the at least one side panel of the air mattress in response to the presence of an external load placed on at least one of the first and second panels of the air mattress.

Additionally, the side support beam may comprise a first side support beam extending in the lengthwise direction of the at least one side panel with the first edge thereof affixed to the at least one side panel and the second edge of the side support beam affixed to the first panel, and a second side support beam extending in the lengthwise direction of the at least one side panel, the first edge of which is affixed to the at least one side panel and the second edge of which is affixed to the second panel. The respective first edges of the two side beams may thus define at least two separate side panel segments of approximate equal width extending across the at least one side panel from the first panel toward the second panel.

In another embodiment, an air mattress is provided comprising a first panel and a spaced second panel, and at least one side panel extending between the first panel and the second panel, each joined to one another along their common peripheral edges to define an air chamber therebetween, with at least one side support beam extending in the lengthwise direction of the at least one side panel. The at least one side support beam has a first edge affixed to the at least one side panel, and a second edge affixed to at least one of the first panel and the second panel, respectively.

The air mattress of this embodiment may further comprise at least one mattress coil disposed within the air chamber, which at least one coil is affixed to and extends continuously from and between the first panel to the second panel, respectively. Alternately, the air mattress comprises a plurality of mattress coils disposed within the air chamber, each coil being separately affixed to and extending continuously from and between the first panel and the second panel.

DETAILED DESCRIPTION OF THE INVENTION

Figure 1:
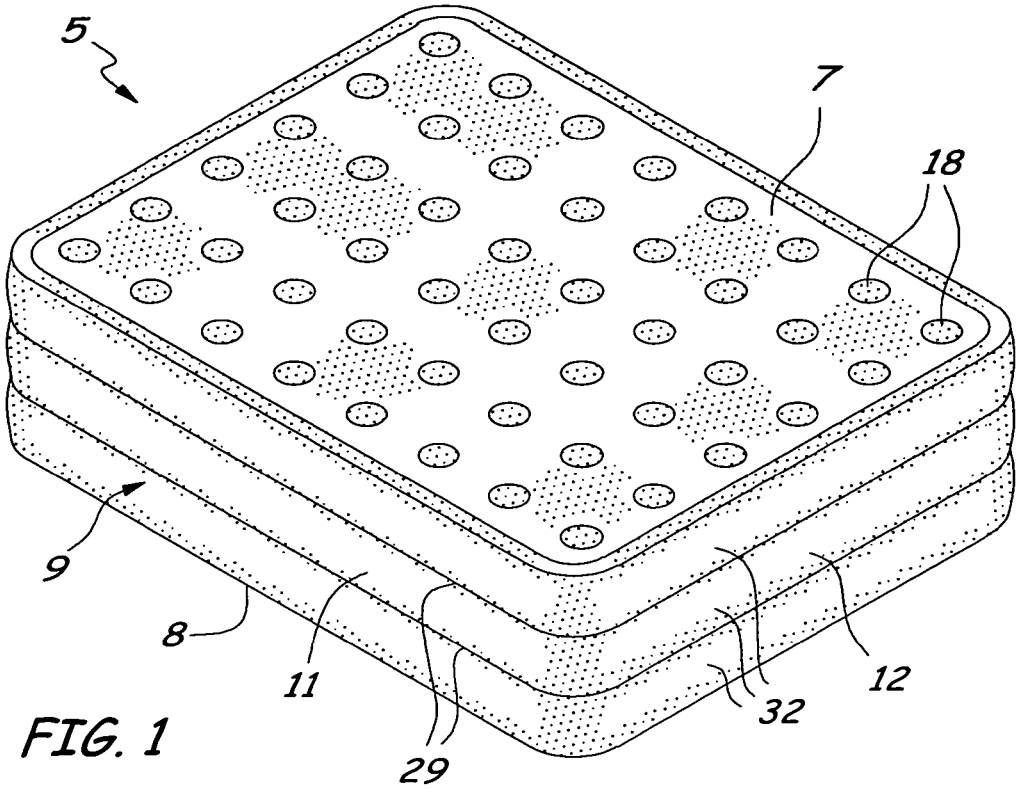
FIG. 1 is a perspective view of an air mattress of the invention.
Figure 2:
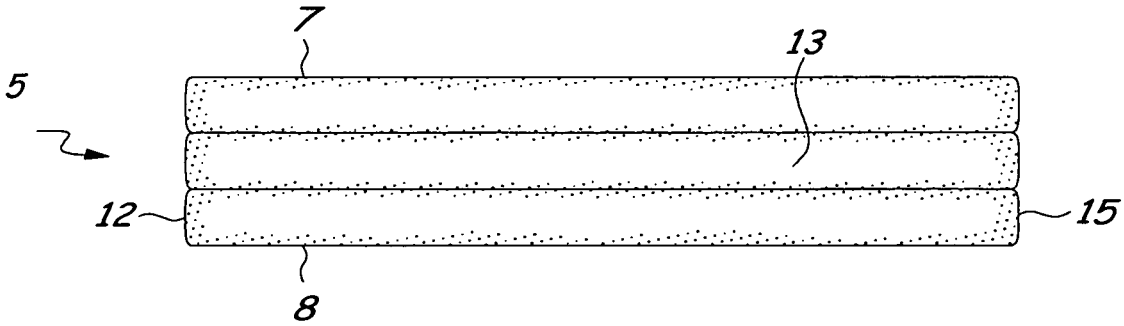
FIG. 2 is first side elevational view of the air mattress of FIG. 1.

Referring now in detail to the drawings, in which like reference characters indicate like parts throughout the several views, an air mattress 5 of the invention is illustrated in FIGS. 1–4. The air mattress is formed of a first planar top panel 7 and a spaced second planar bottom panel 8 with at least one side panel or wall 9 extending between the first panel and the second panel. The at least one side panel, the first panel, and the second panel are conventionally joined to one another along their common peripheral side edges and together define an air chamber 10 within the boundary of the air mattress.

Still referring to FIGS. 1–4, the side panel of the air mattress may be formed of a first side panel 11, a second side panel 12, a third side panel 13, and a fourth side panel 15, each of which is joined to adjacent ones of the side panels, as well as to the first and second panels, respectively, of the mattress along their common peripheral side edges to once again define the air chamber within the mattress. Although an air mattress of a quadrilateral shape in plan view is illustrated in FIGS. 1, 4–6 hereof, it is anticipated that the air mattress may be formed of any desired number of side walls or panels such that the air mattress may have only a single side panel and thus be circular in plan view, have three walls and thus be triangular in plan view, or be of any other desired geometric configuration.

Figure 3:
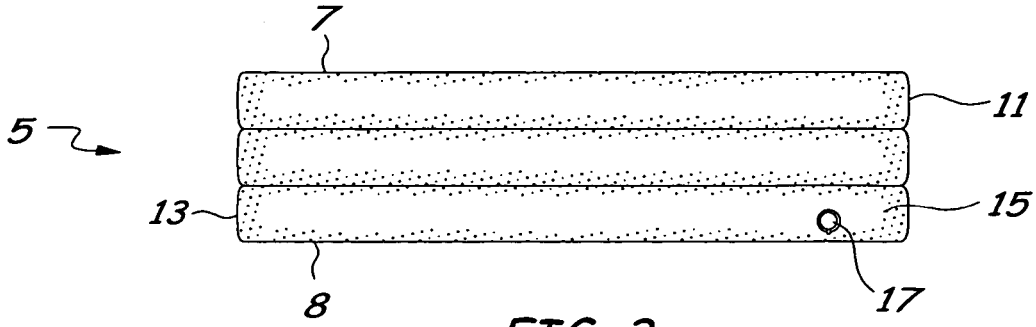
FIG. 3 is a second side elevational view of the air mattress of FIG. 1 illustrating an air fill valve of the mattress
Figure 4:
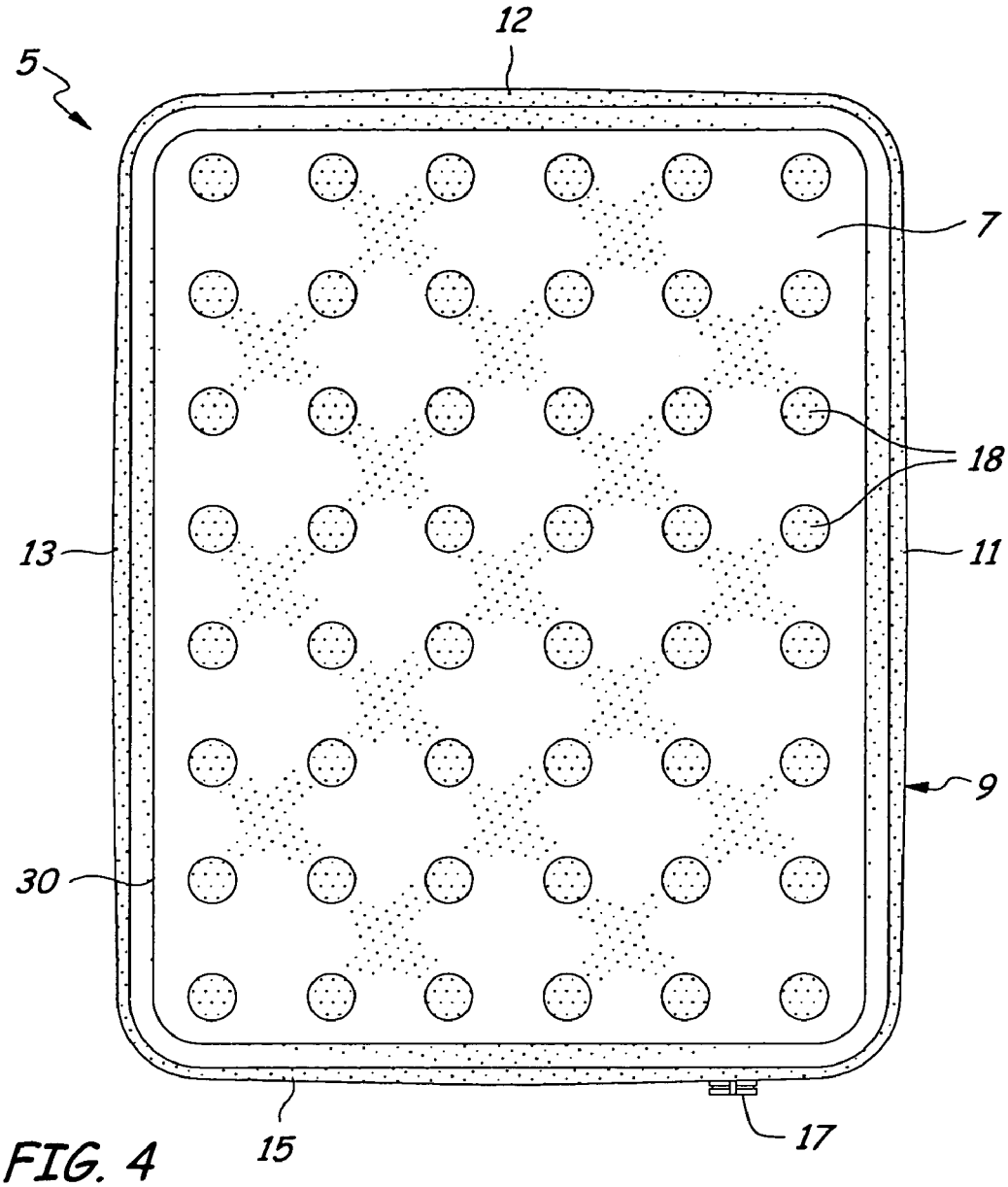
FIG. 4 is top plan view of the air mattress of FIG. 1.
Figure 5:
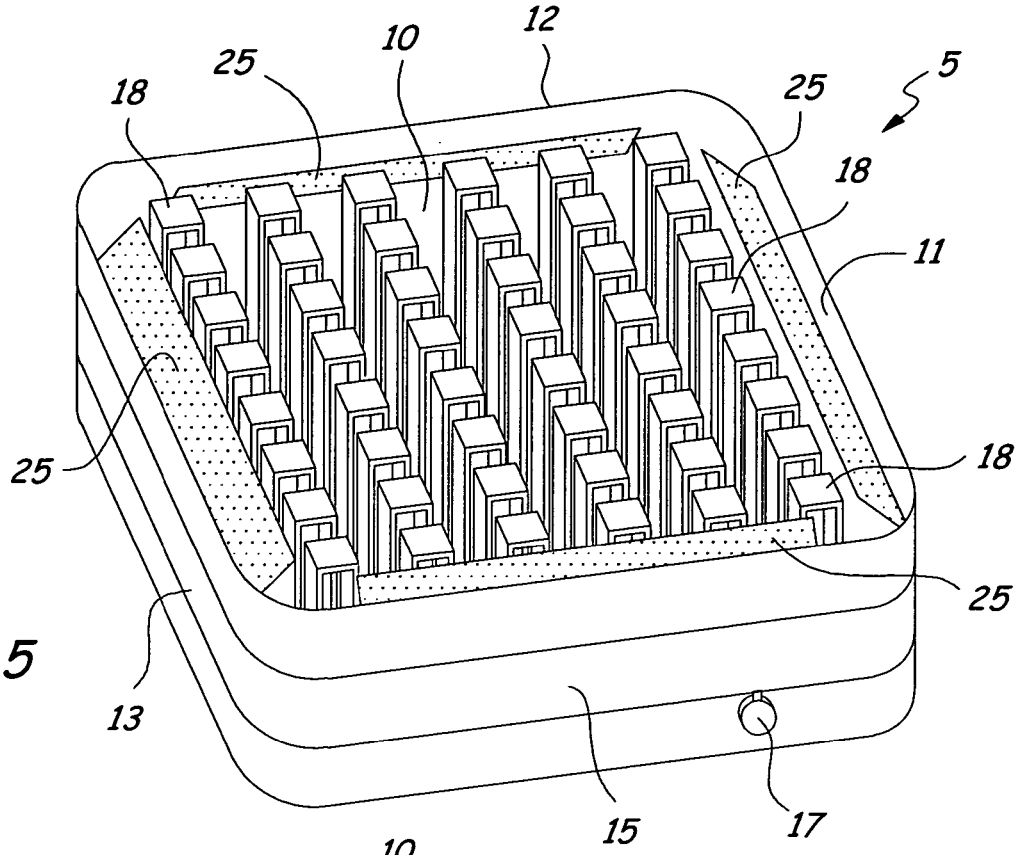
FIG. 5 is a perspective view of an air mattress of the invention in which the top cover panel is removed and the mattress coils thereof are illustrated.
Figure 6:
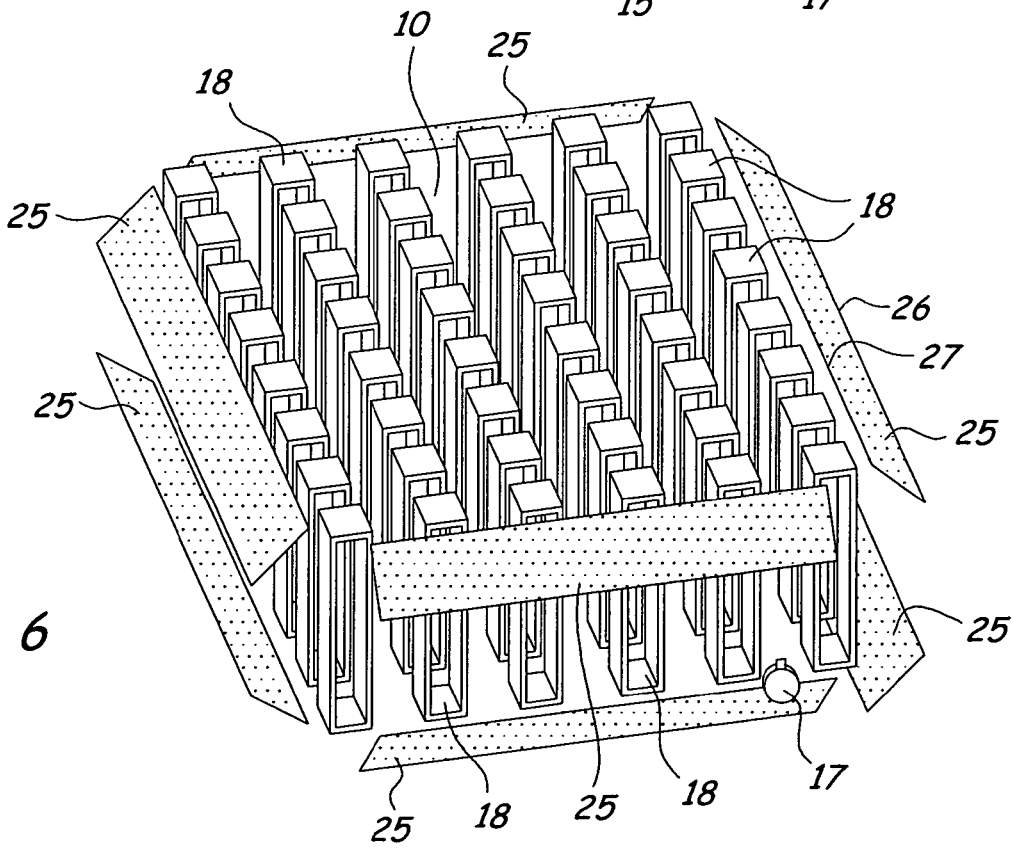
FIG. 6 is a perspective view of an air mattress of the invention with the external surface coverings of the mattress removed to illustrate the coils of the mattress and the side support beam(s) adapted for use with the air mattress.

As shown in each of FIGS. 3–5, the air mattress is provided with an air inlet or fill valve 17 of known construction. The fill valve may be formed in a side panel as shown, or otherwise positioned or formed within either of the top or bottom panels of the mattress, so long as the fill valve is in fluid communication with the air chamber defined within the mattress. Moreover although only a single fill valve is shown, it is anticipated that a greater number of fill valves may be provided if so desired, or there may be a fill valve as shown and a separate drain valve (not illustrated) for use in emptying the air chamber when the mattress is no longer in use or is to be stored.

Referring now to FIGS. 1, and 4–7, the air mattress is provided with at least one elongate mattress coil 18 extended through the air chamber between the top and bottom exterior surface panels 7,8 thereof. As shown, it is anticipated that a series of spaced coils 18 may also be provided within the air chamber for the purpose of tying the first or top exterior surface panel and the second or bottom exterior surface panel directly to one another so that as a load is placed on either panel surface, the mattress panels will remain in a somewhat fixed position with respect to one another for enhancing the performance of the mattress.

The air mattress of the invention preferably comprises a "two-high" or "double-height" single air chamber mattresses having a mattress depth "D" (FIG. 7) measured either along the side wall of the mattress or between the top and bottom surface panels thereof in the range of from about ten inches to upwards of about eighteen to about twenty-four inches. If desired, the inventive air mattress may have a depth greater than eighteen to twenty-four inches, permitted due to the unique construction of the present air mattress.

Although the known types of double-height air mattresses have depths in the range of from about ten inches to upwards of eighteen to twenty-four inches, this is accomplish by using multiple air chambers defined within the periphery of the air mattress. For example, in the known mattresses a first lower air chamber is provided with separate coils or I-beams extended between the respective top and bottom panel surfaces of that air chamber, and a separate second upper air chamber is also provided in which separate coils or I-beams are extended between the top and bottom panel surfaces of that air chamber. So formed the mattress coils or I-beams cannot extend continuously between the top and bottom exterior surface panels of the air mattress, which thus allows for some degree of mattress deformation in response to surface loading. In contrast, the inventive air mattress has only a single air chamber therein which thus permits the coils 18 to extend continuously between the top and bottom surface panels of the mattress.

Figure 7:
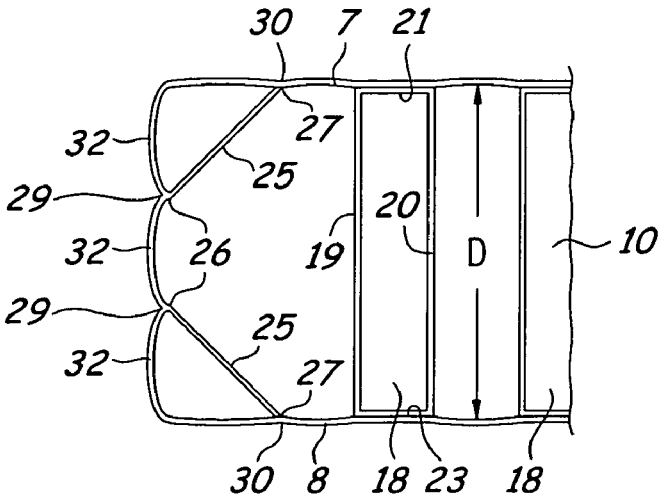
FIG. 7 is a partial cross-sectioned elevational view through the air mattress of FIG. 1.

Referring now to FIGS. 1, and 4–7, and as best illustrated in FIG. 7, each coil 18 has a first elongate member 19 and a spaced second elongate member 20 joined at one end to a first plate 21 and at a spaced second end to a second plate 23. The elongate members and the plates may each be a separate body member joined to the other along their common side (end) edges, or the coil may be formed of a single piece having only two ends/edges joined to one another, or any combination of portions thereof, as desired. Unlike the known double-height air mattresses, however, the coils 18 extend continuously within the air chamber from and between the first panel 7 and the second panel 8 of the air mattress. The plate 21 is affixed to the interior of the panel 7, and the plate 23 is joined to the interior surface of the bottom panel 8 in conventional fashion.

As shown in the drawings, the mattress may include at least one side support beam 25 extended in the lengthwise direction of at least one of the mattress side panels, or along each one of the side panels of the air mattress. The, or each, side support beam has a first edge 26 adapted to be affixed to a side panel of the mattress along a weld or connection line 29, and a spaced second edge adapted to be affixed to either of the first panel 7 or the second panel 8 along a second weld or connection line 30. A shown in FIGS. 1, 4, and 7, the second weld line for each side support beam may extend in substantially parallel fashion to the edge connection or joined edge between the respective first or second panel, and the side panel of the air mattress to which the side support beam is joined.

If so desired, there may be a first side support beam extended in the lengthwise direction of a side panel with the first edge of the side support beam affixed to the side panel and its second edge affixed to the first panel, and a second side support beam also extending in the lengthwise direction of the side panel with the first edge of the side support beam again affixed to the side panel but with its second edge affixed to the second panel. Accordingly, there may be one or two side support beams for at least one side panel of the mattress, for some of the mattress side panels, or for each of the side panels of the air mattress (FIGS. 1, 4–6), as desired. The side support beam or beams, therefore, in concert with the first and/or second panels, respectively, of the air mattress to which the side support beams are attached, thus act to limit the outward expansion of the side panel(s) of the air mattress to which the side support beams are affixed or otherwise attached in response to the presence of a load placed externally on either one of the first panel or the second panel of the mattress.

The respective first edges of the two side support beams may be spaced from one another on the side wall of the mattress as shown in FIG. 7, or may be co-linear and extend along a common edge connection (not illustrated) on the side wall. Where the respective first edges of the two side support beams are spaced equally from one another and the top and bottom panels of the mattress (FIG. 7), the side support beam edges act to define three separate side panel segments 32 of approximate equal width extending across the at least one side panel of the mattress measured from the first panel toward the second panel thereof for more uniformly distributing the mattress loading across the face of the side panel(s). Where the respective first edges of the two side support beams are co-linear with or overlie one another (not illustrated), they will define two separate side panel segments, which side panel segments may be of approximate equal width if so desired, extending across the at least one side panel. The respective first edges of the side support beams may be positioned and spaced from one another as desired along the side panel(s) of the mattress for forming separate side panel segments of any desired width thereacross.

The first mattress panel 7, the second mattress panel 8, the side panel(s) 11–13, and 15, the mattress coils 18, and the side support beam(s) 25 are each attached or otherwise affixed to one another, as described above, by using any known heat welding, fusing, or bonding technique, as well as through the use of any known adhesive, all in conventional fashion so long as a durable edge connection is formed therebetween; and for those edge connections between the first panel, the second panel, and the side panel(s) of the air mattress, so that a fluid tight edge connection is formed. Moreover, the first mattress panel, the second mattress panel, the side panel(s), the mattress coils, and the side support beams of the air mattress may be formed of any flexible barrier material as known to those skilled in the art, including but not limited to, the use of polyvinylchloride, polyethylene, and the like Although several embodiments of the invention have been disclosed in the foregoing specification, it is understood by those skilled in the art that many modifications and other embodiments in the invention will come to mind to which the invention pertains, having the benefit of the teaching presented in the foregoing description and the associated drawings. It is thus understood that the invention is not limited to the specific embodiments disclosed hereinabove, and that many modifications and other embodiments are intended to be included within the scope of the invention.

Moreover, although specific terms are employed herein, they are used in the generic and descriptive sense only, and are not intended to limit the scope of the invention; and the words "a," "and," or "the" as they appear herein may mean one or more, depending upon the context in which the words are used, and are not otherwise intended to limit the scope of the disclosed invention.

I claim:

1. An air mattress, comprising:

a first panel and a spaced second panel;

at least one side panel extending between the first panel and the second panel;

the at least one side panel, the first panel, and the second panel being joined to one another along their common peripheral edges to define an air chamber therebetween, the air chamber having a depth measured between the first panel and the second panel in the range of from about ten inches to about eighteen to about twenty-four inches;

at least one mattress coil disposed within said air chamber, said at least one coil being affixed to and extending continuously from the first panel to the second panel, respectively;

a first side support beam extending in the lengthwise direction of the at least one side panel, said first side support beam having a first edge affixed to the at least one side panel, a second edge affixed to the first panel, and a section between the first edge and the second edge where the first side support beam is attached neither to said at least one side panel nor the first panel, the first side support beam being arranged such that when the air chamber is filled with air, the section of the first side support beam is in tension and the first side support beam limits outward expansion of said at least one side panel; and a second side support beam extending in the lengthwise direction of the at least one side panel, said second side support beam having a first edge affixed to the at least one side panel, a second edge affixed to the second panel, and a section between the first edge and the second edge where the second side support beam is attached neither to said at least one side panel nor the second panel, and the second side support beam being arranged such that when the air chamber is filled with air, the section of the second side support beam is in tension and the second side support beam limits outward expansion of said at least one side panel.

2. The air mattress of claim 1, wherein the respective first edges of the two side support beams are spaced from one another on the at least one side wall of the mattress.

3. The air mattress of claim 1, wherein the first edge of the first side support beam and the second edge of the second side support beam are spaced evenly from one another and the first and second panels, respectively.

4. The air mattress of claim 1, wherein the first side support beam and the second side support beam are each constructed and arranged to limit the outward expansion of the at least one side panel of the air mattress.

5. The air mattress of claim 1, said at least one mattress side panel further comprising a first side panel, a second side panel, a third side panel, and a fourth side panel, each said side panel extending between the top panel and the bottom panel of the mattress and being joined to adjacent ones of the side panels, the top panel, and the bottom panel, respectively, along their common peripheral edges to define said air chamber.

6. The air mattress of claim 5, further comprising an internal side support beam extending in the lengthwise direction of at least one of said side panels, the internal side support beam having a first edge affixed to an inside of said at least one side panel and a second edge affixed to the inside of at least one of the top panel and the bottom panel.

7. The air mattress of claim 5, further comprising at least one internal side support beam extending in the lengthwise direction of each said side panel, each said at least one internal side support beam having a first edge affixed to an inside of a respective one of the side panels and a second edge affixed to an inside of at least one of the top panel and the bottom panel.

8. The air mattress of claim 7 further comprising a pair of internal side support beams extending in the lengthwise direction of each said side panel, each said internal side support beam having a first edge and a second edge, wherein the first edge of the first side support beam is affixed to inside of the side panel and the second edge thereof is affixed to the inside of the top panel, and the first edge of the second side support beam is affixed to inside of the side panel and the second edge thereof is affixed to inside of the bottom panel.

9. The air mattress of claim 5, further comprising:

a first internal side support beam extending in the lengthwise direction of at least one of said side panels, said internal first side support beam having a first edge affixed to the inside of the at least one side panel and a second edge at least partially affixed to the inside of the top panel; and a second internal side support beam extending in the lengthwise direction of said at least one side panel, said second internal side support beam having a first edge affixed to the inside of the at least one side panel and a second edge at least partially affixed to the inside of the bottom panel.

10. An air mattress, comprising:

a first panel and a spaced second panel;

at least one side panel extending between the first panel and the second panel;

the at least one side panel, the first panel, and the second panel being joined to one another along their common peripheral edges to define an air chamber therebetween;

a first side support beam extending in the lengthwise direction of the at least one side panel, said first side support beam having a first edge affixed to the at least one side panel, a second edge affixed to the first panel, and a section between the first edge and the second edge where the first side support beam is attached neither to said at least one side panel nor the first panel, the first side support beam being arranged such that when the air chamber is filled with air, the section of the first side support beam is in tension and the first side support beam limits outward expansion of said at least one side panel; and a second side support beam extending in the lengthwise direction of the at least one side panel, said second side support beam having a first edge affixed to the at least one side panel, a second edge affixed to the second panel, and a section between the first edge and the second edge where the second side support beam is attached neither to said at least one side panel nor the second panel, the second side support beam being arranged such that when the air chamber is filled with air, the section of the second side support beam is in tension and the second side support beam limits outward expansion of said at least one side panel.

11. The air mattress of claim 10, wherein the first edge of the first side support beam and the second edge of the second side support beam are each spaced evenly from one another and the first and second panels, respectively.

12. The air mattress of claim 10, wherein the first side support beam and second side support beam are constructed and arranged to limit the outward expansion of the at least one side panel of the air mattress in response to the presence of a load external to the air mattress placed on at least one of the first panel and the second panel, respectively.

13. An air mattress, comprising:

a top panel and a spaced bottom panel;

at least one side panel extending between the top panel and the bottom panel;

the at least one side panel, the top panel, and the bottom panel being joined to one another along their common peripheral edges to define an air chamber therebetween; and at least one internal side support beam extending in the lengthwise direction of the at least one side panel, the at least one internal side support beam having a first edge affixed to an inside of the at least one side panel, a second edge affixed to an inside of at least one of the top panel and the bottom panel, and a section between the first edge and the second edge where the first side support beam is attached neither to said at least one side panel nor said at least one of the top panel and the bottom panel, the internal side support beam being arranged such that when the air chamber is filled with air, the section of the internal side support beam is in tension and the internal side support beam limits outward expansion of said at least one side panel.

14. The air mattress of claim 13, wherein the second edge of the at least one internal side support beam affixed to one of the top and bottom panels, respectively, extends substantially parallel to the joined edge of said one of the top and bottom panels and the at least one side panel.

15. The air mattress of claim 13, further comprising at least one mattress coil disposed within said air chamber, said at least one coil being affixed to and extending continuously from the top panel to the bottom panel, respectively.

16. The air mattress of claim 15, further comprising a plurality of mattress coils disposed within said air chamber, each said coil being separately affixed to and extending continuously from the top panel to the bottom panel, respectively.

17. The air mattress of claim 13, said air chamber having a depth measured between the top panel and the bottom panel in the range of from about ten inches to about eighteen to about twenty-four inches.

18. The air mattress of claim 13, said at least one mattress side panel further comprising a first side panel, a second side panel, a third side panel, and a fourth side panel, each said side panel extending between the top panel and the bottom panel of the mattress and being joined to adjacent ones of the side panels, the top panel, and the bottom panel, respectively, along their common peripheral edges to define said air chamber.

19. The air mattress of claim 18, further comprising an internal side support beam extending in the lengthwise direction of at least one of said side panels, the side support beam having a first edge affixed to an inside of said at least one side panel and a second edge affixed to an inside of at least one of the top panel and the bottom panel.

20. The air mattress of claim 18, further comprising at least one side support beam extending in the lengthwise direction of each said side panel, each said at least one side support beam having a first edge affixed to a respective one of the side panels and a second edge affixed to at least one of the top panel and the bottom panel.

21. An air mattress, comprising:

a first panel and a spaced second panel;

at least one side panel extending between the first panel and the second panel;

the at least one side panel, the first panel, and the second panel being joined to one another along their common peripheral edges to define an air chamber therebetween; and a pair of side support beams extending in the lengthwise direction of each said side panel, each said side support beam having a first edge and a second edge, wherein the first edge of the first side support beam is affixed to the side panel and the second edge thereof is affixed to the first panel and a section between the first edge and the second edge is attached neither to said at least one side panel nor the first panel, and the first edge of the second side support beam is affixed to the side panel and the second edge thereof is affixed to the second panel and a section between the first edge and the second edge is attached neither to said at least one side panel nor the second panel, each side support beam being arranged such that when the air chamber is filled with air, the section of each side support beam is in tension and the side support beam limits outward expansion of said at least one side panel.

* * * * *